United States Patent [19]

Gauld

[11] Patent Number: 4,793,392

[45] Date of Patent: Dec. 27, 1988

[54] BENDING DEVICE

[75] Inventor: Stephen K. Gauld, Richmond Hill, Canada

[73] Assignee: Oakridge Railing and Stair Company Inc., Richmond Hill, Canada

[21] Appl. No.: 151,951

[22] Filed: Feb. 3, 1988

[51] Int. Cl.[4] ..... B27H 1/00

[52] U.S. Cl. ..... 144/256.1; 100/237; 156/581; 144/256.4

[58] Field of Search ..... 144/254, 256.1, 256.4, 144/262, 270; 425/398; 156/581; 100/237

[56] References Cited

U.S. PATENT DOCUMENTS

| | | | |
|---|---|---|---|
| 51,826 | 1/1866 | Griffiths | 144/256.1 |
| 829,125 | 8/1906 | Romunder | 144/256.4 |
| 965,927 | 8/1910 | Nichols | 144/256.1 |
| 977,804 | 12/1910 | Knilans | 144/256.4 |
| 2,335,488 | 11/1943 | Bergstrom | 144/256 |
| 2,399,348 | 4/1946 | Hobbs | 144/256.1 |
| 2,431,353 | 11/1947 | Varner et al. | 144/256.1 |
| 2,662,564 | 12/1953 | Payzant | 144/254 |
| 2,766,787 | 10/1956 | Knowles | 144/256.4 |
| 3,027,923 | 4/1962 | Schreiber | 144/256.1 |

*Primary Examiner*—W. Donald Bray
*Attorney, Agent, or Firm*—Riches, McKenzie & Herbert

[57] ABSTRACT

A bending device for curving sheet-like members, comprising a row of double roller clamp means, each having a pair of parallel rollers adapted to receive and clamp the sheet-like member therebetween. Hinge means are located between each adjacent pair of clamp means for hingeably coupling each clamp means to an adjacent clamp means. Actuating means are provided, connected between each adjacent pair of clamp means, which are operable to cause pivoting of the double roller clamp means about the hinge means, thereby curving the row of clamp means, and accordingly the sheet-like member clampingly held by each of the clamp means. In a preferred embodiment, the clamp means are laterally displaceable along the hinge means relative to an adjacent clamp means, to allow alignment of the clamp means along a diagonal. In a further preferred embodiment, the actuating means comprises pairs of pistons pivotally connected between adjacent pairs of clamp means in non-parallel relation to each other, so that the pair of pistons may cause a desired amount of pivoting about, and lateral displacement along, the hinge means.

12 Claims, 5 Drawing Sheets

BENDING DEVICE

INTRODUCTION

This invention relates to a device for curving sheet-like member, and more particularly to a mechanical bending device having a row of adjacent double roller clamp means, each clamp means adapted to allow placement of a sheet-like member therebetween for curving of the sheet-like member. This invention has particular applications for laminating and curving of plywood sheets for use in circular stair stringers.

BACKGROUND OF THE INVENTION

Numerous devices exist for the curving and also laminating of wooden beams, plywood, or sheet-like members. Most commonly, such devices supported the sheet-like member or beam, at each of its ends, and applied a load, or series of loads, to the member intermediate the ends of the member, so as to cause curving of the member. The amount of curving was determined by the distance the load-applying member or members travelled when in contact with the sheet-like member or beam.

U.S. Pat. No. 2,399,348 disclosed one such device, having a plurality of cylindrical fixed horns 32,34, arranged in the desired curved pattern, and a plurality of load-applying cylindrical movable horns 44. The movable horns are adapted to apply a load to the sheet-like member forcing it against the fixed horns 32 or 34, thereby forcing the sheet-like member to assume the predetermined curved pattern of the fixed horns 32 or 34.

U.S. Pat No. 2,662,564 discloses a continuous gluing press, having a plurality of mutually opposed adjustable collars adjustably aligned along a path, so that a sheet-like member is curved when advanced along such path and between such collars.

Such prior art devices are relatively complex and accordingly costly to manufacture. More particularly, however, the prior art devices do not easily lend themselves to ready adjustment to accommodate curving of sheet-like members in various planes which are inclined to the longitudinal axis of the sheet-like member. Accordingly, the prior art devices must be made of a much greater size than actually required to allow various alignment of the sheet-like members within such devices, in order to be able to achieve curving of such members along the appropriate desired plane.

Accordingly, because of the disadvantages of the known prior art devices, the present known method for manufacturing curved laminated stair stringers for use in spiral wooden staircases employs a curved form. A strip of laminated wood in the form of a sheet-like member which is desired to be curved is manually clamped around the perimeter of this form, typically by a plurality of "C" clamps, in a helical spiral manner, in order to form the circular wooden stair stringer in the desired curved shape. Once the glue within the laminated strips of plywood of the stair stringer has set in the desired shape about the form, the circular stair stringer is removed from the form, and subsequently used in fabricating the circular spiral staircase.

The above prior art method for fabricating such circular stair stringers, using a pre-curved form and clamps to form the stringer, requires lengthy assembly times in manually clamping the laminated strips to the shaped form. In addition, where a number of different circular stair stringers are desired to be fabricated, a corresponding number of different forms are required, each having different curvatures and pre-defined shapes, depending on the desired shape of the circular stair stringer. This results in further expense. Also, since the desired circular stair stringer for a spiral stair case is relatively large, a great deal of floor space is taken up in a manufacturing plant which manufactures substantial quantities of variously configured circular stair stringers, since a number of these forms are required to be on hand to form the various circular stair stringers.

Accordingly, there is a long-standing need for a single automated bending device which may simultaneously bend and laminate a sheet-like member into various desired curved configurations, without time-consuming clamping onto various curved forms, and without taking up large amounts of space.

SUMMARY OF THE INVENTION

In order to overcome the disadvantages inherent in the prior art devices, the present invention provides for a bending device, having a plurality of double roller clamp means, each clamp means having first and second parallel elongated rollers adapted to clamp a sheet-like member therebetween. Each double clamp means is further hingedly coupled along a hinged axis to an adjacent clamp means, thereby forming a row of hingedly coupled double clamp means. Actuating means are further provided to cause pivoting of the clamp means about the hinged axes, so as to curve the row of clamp means, and thereby curve the sheet-like member held between the rollers of each double clamp means.

Accordingly, in one of its broad aspects, the invention comprises a device for curving a sheet-like member, comprising: at least three spaced double roller clamp means, each clamp means having first and second parallel elongated rollers and operating means to open and close the rollers together, the double roller clamp means being arranged in a row to receive and clamp a sheet-like member between the rollers thereof; a plurality of hinge means, one hinge means being located between and pivotally connected to each adjacent pair of double roller clamp means; and a plurality of actuating means, at least one actuating means being connected between each adjacent pair of double roller clamp means, the actuating means being operable to pivot the double roller clamp means about the hinge means to curve the row of double roller clamp means.

As a further refinement to the invention, the hinge means which hingeably couples one double clamp means to an adjacent clamp means may further allow lateral slidable displacement of the double clamp means relative to the adjacent clamp means, along the axis of pivotal coupling. This capability further advantageously allows the double roller clamp means to be aligned along a diagonal by uniform lateral displacement of each the double roller clamp means along the hinge means relative to an adjacent double roller clamp means.

Accordingly, by aligning the double clamp means in such a manner along a diagonal, a sheet-like member may then be placed between the first and second rollers, along such diagonal, and be curved upon activation of the actuating means which cause curving of the row of double roller clamp means. This further refinement allows the sheet-like member to be curved in a plane which is inclined to the longitudinal axis of the sheet-like member. Advantageously, then, the sheet-like member is not only curved, but is accordingly given a twist, or helical spiral. The invention accordingly is extremely useful in the laminating and curving of circular stair stringers from plywood sheets, wherein such laminated wood stair stringers are not only required to be curved, but also are required to possess a helical spiral.

In fabricating circular stair stringers using the bending device of the present invention, it is necessary that the bending device be able to produce circular stair stringers having a left-handed twist, or a right-handed twist. Accordingly, in the further refinement of the invention described above, it is contemplated that the double roller clamp means be laterally slidable in either direction relative to an adjacent double roller clamping means, to allow each double roller clamp means to be laterally displaced along a diagonal on either side of an adjacent double roller clamp means. In this way, the double roller clamping means may be uniformly laterally displaced along one diagonal to effect curving of a circular stringer with a left-handed twist, and each double clamp means may also, if desired, be uniformly laterally displaced in the opposite direction relative to an adjacent clamp means, to allow alignment along another diagonal to effect curving of a circular stair stringer with a right-handed twist.

It is contemplated that the actuating means for curving the double roller clamp means comprise piston means, and in a preferred embodiment, such piston means comprises a first and second piston, each connected at their respective ends between an adjacent pair of double roller clamp means.

In one embodiment it is contemplated the first and second pistons be pivotally connected to adjacent pairs of double roller clamp means, substantially parallel to each other, and perpendicular to the axis of pivoting along which the hinge means is located. In this embodiment, the piston means only fulfil the role of causing pivoting of the double clamp means about the hinge means, thereby curving the row of double roller clamp means.

More particularly, in a further preferred embodiment of the invention, it is contemplated that each of said first and second pistons be pivotally connected to each member of an adjacent pair of double roller clamp means proximate the second rollers located thereon, and the hinge means be located along an axis substantially intermediate the adjacent pair of double roller clamp means.

Alternatively, each of said first and second pistons may be pivotally connected to each member of an adjacent pair of double roller clamp means proximate the first rollers thereof. Such positioning of the pistons allows the row of adjacent double roller clamp means to be curved upon contraction of the piston means, wherein the double roller clamp means are forced to pivot about the hinge means.

Where it is desired that the double roller clamp means also be laterally displaceable along the axis on which the hinge means is located, it has been found that the first and second piston means may also be employed to effect the desired lateral displacement of the double clamp means, in addition to causing the pivoting of the double clamp means by rotation about the hinged axis on which the hinge means is located.

Advantageously, then, the first and second pistons may each be respectively pivotally coupled to adjacent pairs of double roller clamp means in non-parallel relation with each other, at an angle to the hinged axis, so that extension or contraction of either piston has both component in a direction perpendicular to the axis of pivoting on which the hinge means is located, and a component in a direction parallel and along the hinged axis.

Accordingly, then, in a further preferred embodiment of the invention utilizing first and second non-parallel pistons, it is contemplated that such first and second pistons each be respectively pivotably coupled at one end thereof to a double roller clamp means proximate respective opposite extremities of said double clamp means, said first and second pistons each coupled at their respective other ends to an adjacent double roller clamp means, so as to be in non-parallel relation with each other, wherein adjustable extension or contraction of each of said first and second pistons produces a desired amount of lateral slidable displacement along, and pivoting about, said hinge means of each of said double roller clamp means relative to an adjacent double roller clamp means.

It is preferable that the first and second pistons be coupled at their said respective other ends intermediate the extremities of the adjacent double roller clamp means, and proximate the center thereof, and further, that they be coupled to the adjacent double roller clamp means at the same location thereon. In such configuration the first and second pistons may easily be individually adjusted so as to cause either lateral slidable displacement along, or pivoting about, the hinge means of each of the double roller clamp means.

More particularly, in a further preferred embodiment of this particular aspect of the invention, it is contemplated that each of the double roller clamp means be laterally displaceable along the hinge means relative to an adjacent pivotally connected double roller clamp means, the actuating means comprising first and second pistons, each respectively pivotally coupled at one end thereof to the double roller clamp means proximate the respective extremities of a second roller located thereon, said first and second pistons coupled at their respective other ends to an adjacent double roller clamp means, intermediate the extremities of a correspondingly adjacent second roller located thereon, so as to be in non-parallel relation with each other, and the hinge means located along an axis substantially intermediate the adjacent pairs of double clamp means, wherein adjustable extension or contraction of each of said first and second pistons causes a desired amount of lateral slidable displacement along, and pivoting about, said axis of each of said double roller clamp means relative to an adjacent double roller clamp means.

BRIEF DESCRIPTION OF THE DRAWINGS

Further objects and advantages will appear from the following detailed description of the invention, taken together with the accompanying drawings in which.

DETAILED DESCRIPTION OF THE INVENTION

Figure 1:
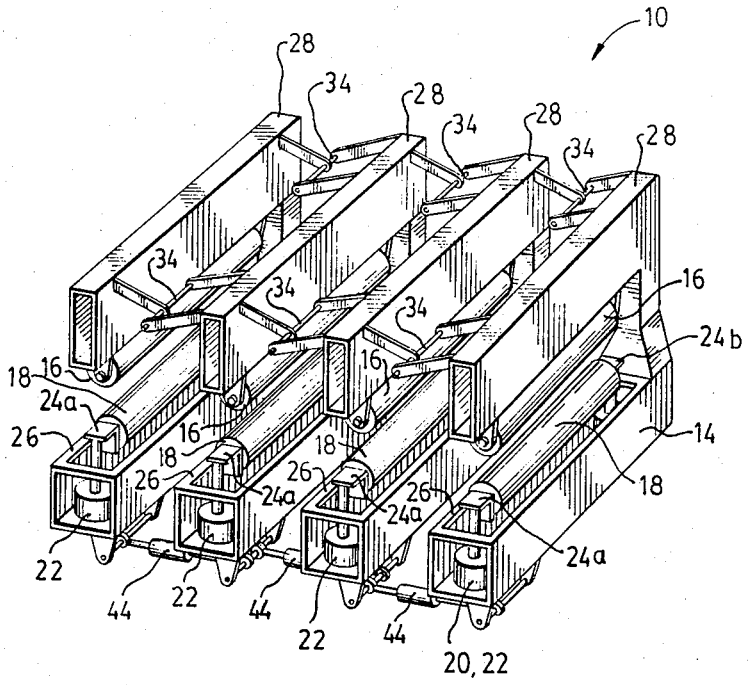
FIG. 1 is a perspective view of a first embodiment of the bending device of the present invention, showing the bending device in its uncurved configuration.
Figure 2:
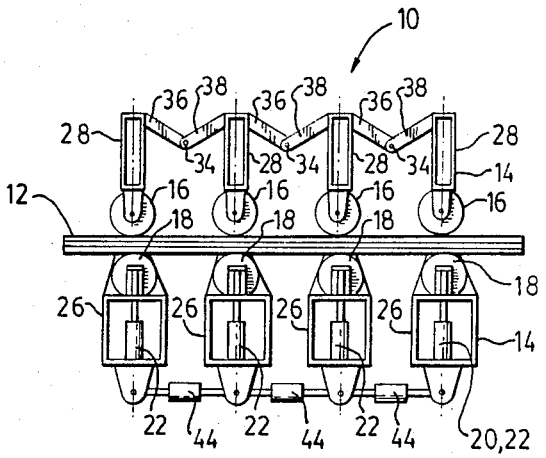
FIG. 2 is a side elevation view of the first embodiment of the invention shown in FIG. 1, showing a sheet-like member positioned in the bending device prior to curving thereof.
Figure 3:
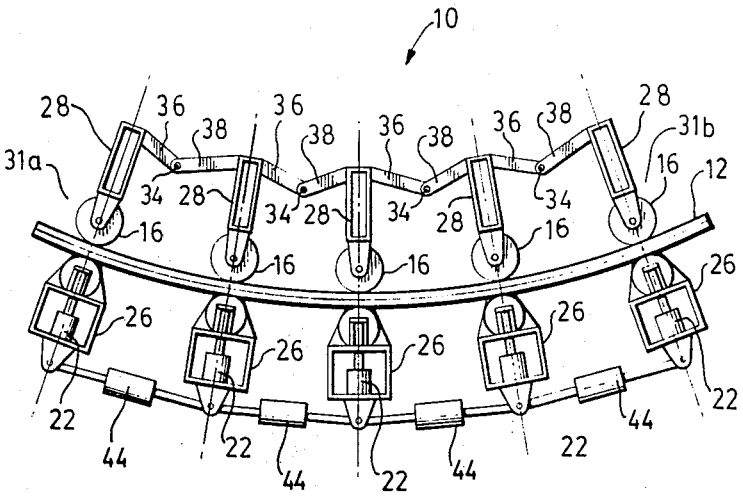
FIG. 3 is a side elevation view of the first embodiment of the invention similar to FIG. 2, showing the bending device in a curved, bending position.

FIGS. 1, 2 and 3 show a first embodiment of the bending device 10 of the present invention, for bending or laminating a sheet-like member 12 into a curved configuration. Such device 10 comprises at least three spaced double roller clamp means 14 arranged in a row, each having a first parallel elongated roller 16 and second parallel elongated roller 18 rotatably mounted thereon, wherein the double roller clamp means 14 are each adapted to clampingly engage the sheet-like member 12 between the first 16 and second 18 rollers thereof.

Operating means 20, such as clamping pistons 22, are provided on each double roller clamp means 14, for opening and closing the rollers 16,18 together. This allows one or more sheet-like members 12 to be inserted between such rollers, and clampingly held together by the rollers during curving and lamination of such member 12. In a preferred embodiment shown in FIGS. 1–3, clamping pistons 22 are rotatably coupled at one end to the second rollers 18 of each of the double clamp means 14 at opposite extremities 24*a,b* of the second rollers, and affixed at their other ends to the lower horizontal member 26 of the double roller clamp means 14.

Alternatively, clamping pistons 22 may be affixed to the upper horizontal member 28 of the double roller clamp means 14, and rotatably coupled to the first roller 16 of each of the double roller clamp means 14 at opposite extremities thereof. In this manner, the first rollers 16 may be forcibly biased against the second rollers 18 by each of the clamping pistons 22.

Figure 4:
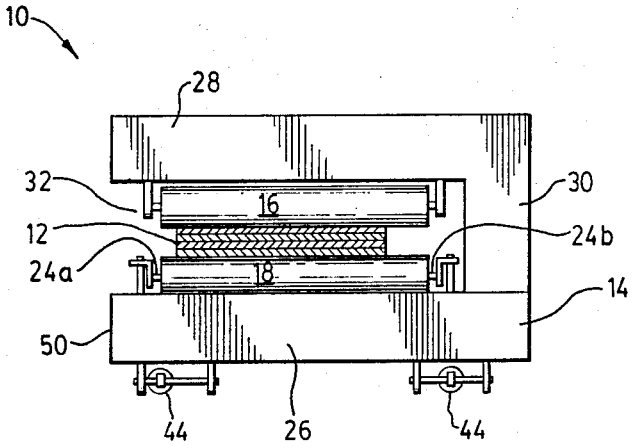
FIG. 4 is an end view of the bending device of the present invention, showing a sheet-like member clampingly held between rollers of the double roller clamp means.

In all embodiments of the invention, the upper horizontal member 28 of the double roller clamp means 14 is fixedly attached to the lower horizontal member 26, as can be clearly seen in FIG. 4. In a preferred embodiment, however, the upper and lower horizontal members 26,28 are only fixedly attached to each other at one end 30 thereof, leaving the other end 32 open, to thereby form a generally "C" shaped double roller clamp means 14. Such configuration facilitates removal of the sheet-like member 12 once the member 12 has been curved and the clamping pistons 22 have been released from clamping engagement with the sheet-like member. As may be seen from FIG. 3, the sheet-like member 12 may easily be removed from the bending device 10 once the sheet-like member has been uniformly curved, by slidable removal from either the left-hand side 31*a*, or right-hand side 31*b* of the device 10. However, removal in this manner from either side 31*a*,31*b* of the bending device 10 when the sheet-like member is not uniformly curved is impossible. Accordingly, in the situation where the sheet-like member is not uniformly curved, removal of the sheet-like member 12 from the bending device 10 is achieved by removal thereof from the open-ended side 32, as shown in FIG. 4. Alternately, temporary closure means (not shown) may also be provided to temporarily close open end 32 during the bending operation, yet allow access to such end 32 to allow removal of the curved sheet-like member 12.

Figure 8:
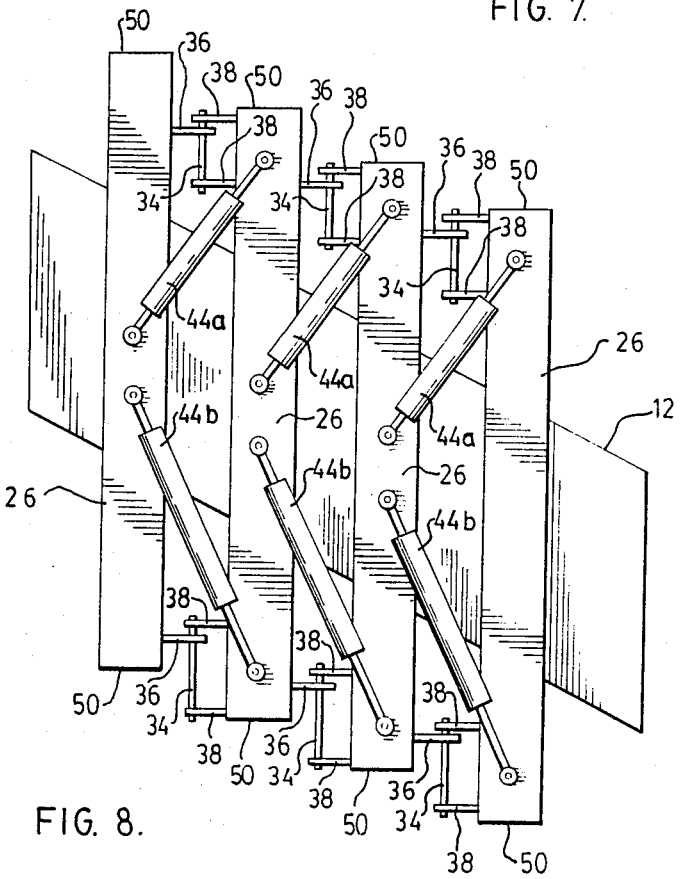
FIG. 8 is a bottom view of the second embodiment of the invention shown in FIG. 7, showing the double roller clamp means aligned along a diagonal for providing curving and twisting of the sheet-like member.
Figure 9:
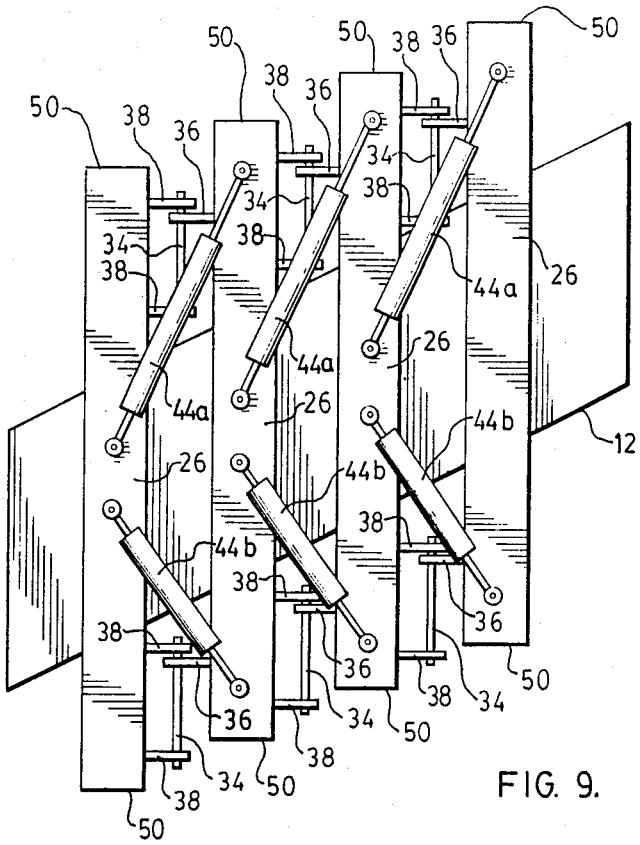
FIG. 9 is a bottom view of the second embodiment of the invention similar to FIG. 8, showing the double roller clamp means aligned along another diagonal for curving and twisting of the sheet-like member in a direction opposite to the direction of curvature provided in FIG. 8.
Figure 10:
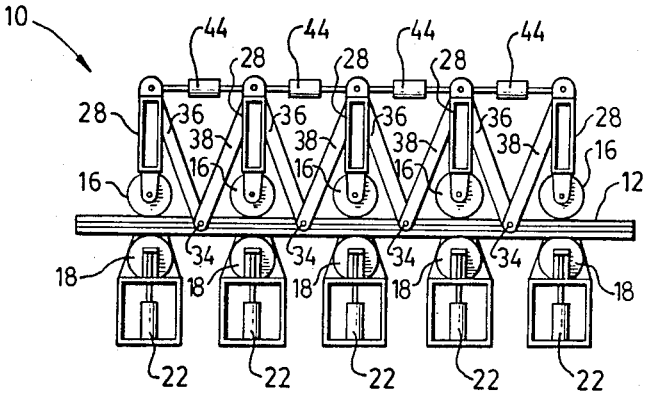
FIG. 10 is a side elevation view of a third embodiment of the bending device of the present invention.

In order to achieve bending or curving of the row of double roller clamp means 14, hinge means 34 are located between and pivotably connected to each adjacent pair of double roller clamp means 14, as shown in FIGS. 1–3 and 5–10. In a preferred embodiment, the hinge means 34 are located substantially intermediate the upper horizontal members 28 of the double roller clamp means, but may also be located anywhere intermediate adjacent pairs of double roller clamp means 14. FIG. 10 shows an alternate location of the hinge means 34 in another embodiment of the invention.

In the preferred embodiment of the invention, the hinge means 34 comprises a plurality of arms 36,38 hingedly coupled together so as to allow pivotal connection of one double roller clamp means 14 to an adjacent double roller clamping means 14.

In order to not only curve a sheet-like member 12, but to also impart a helical twist to such member, it is desirable to allow lateral slidable displacement of each of the double roller clamp means 14. This may be accomplished by adapting the hinge means 34 to allow lateral slidable displacement of a double roller clamp means 14 relative to an adjacent double roller clamp means 14 along an axis on which the double roller clamp means 14 is pivotally coupled to its adjacent double roller clamp means 14.

FIGS. 5, 6, 8 and 9 clearly show a hinge means 34 adapted to allow such lateral slidable movement. In this embodiment, a pair of arms 38 are provided, fixedly attached to an upper horizontal member 28 and pivotally connected along a spindle 37. The spindle 37 provides an axis about which an adjacent double roller clamp means may be pivoted, and along which it may be laterally slidably displaced. Other hinge means 34 commonly known in the art may of course be used which also provide a lateral displacement slidable capability along the hinged axis.

In the above manner, each of the double roller clamp means 14 may be uniformly slidably displaced relative to an adjacent double clamp means 14, so as to allow alignment of each double roller clamp means 14 along a diagonal. Slidable displacement of the double roller clamp means 14 in either direction relative to each other provides the bending device 10 with the capability of curving and at the same time providing a twist in either direction to the sheet-like member 12. Accordingly, FIG. 5 shows a top view, and FIGS. 6 and 8 each show a bottom view, of the bending device 10 of the present invention having such capability, wherein the double roller clamp means 14 are uniformly displaced in a similar direction relative to each other, to allow curving of the sheet-like member 12, and also providing such member 12 with a right-handed twist.

Figure 5:
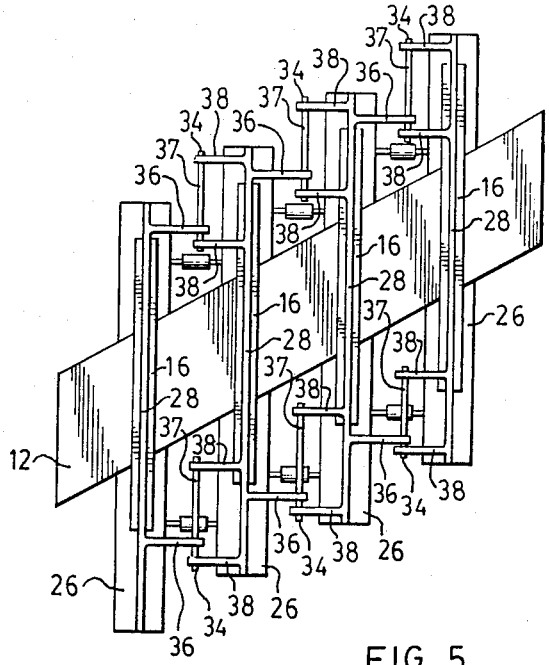
FIG. 5 is a bottom view of the first embodiment of the invention shown in FIGS. 1 and 2, showing the double roller clamp means aligned along a diagonal for providing curving and twisting to the sheet-like member.
Figure 6:
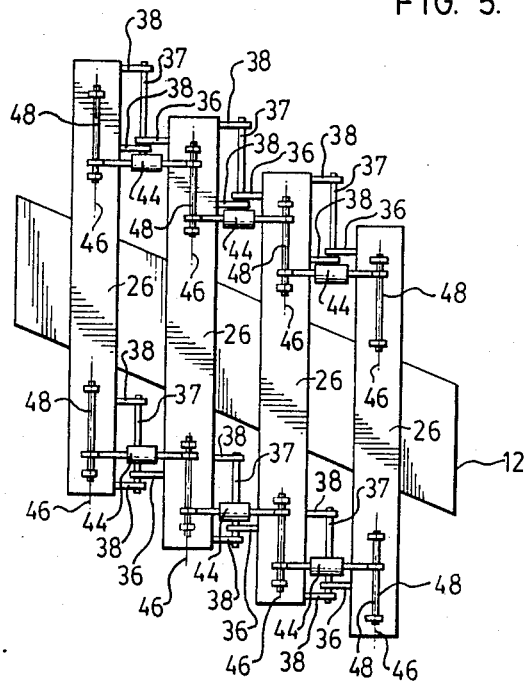
FIG. 6 is a bottom view of the first embodiment of the invention similar to FIG. 5, showing the double roller clamp means aligned along another diagonal for curving and twisting of the sheet-like member, in a direction opposite to the direction of curvature provided in FIG. 5.

FIG. 9 shows a bottom view of the bending device 10 having the same capability, wherein the double roller clamp means 14 have been uniformly displaced relative to each other in an opposite direction to that shown in FIGS. 5, 6 and 8, to allow curving of the sheet-like member 12 in the opposite direction, and to accordingly provide a left-handed twist.

In order to pivot the row of double roller clamp means 14 about the hinge means 34 to cause curving of the bending device 10, and thereby curvature of the sheet-like member 12, activating means are provided, at least one actuating means being connected between each adjacent pair of double roller clamp means 14, and operable to pivot the double roller clamp means 14 about the hinge means 34.

In a preferred embodiment of the device 10, such actuating means are comprised of a plurality of actuating pistons 44, at least one actuating piston 44 being pivotally connected between adjacent pairs of double roller clamp means 14.

In a preferred embodiment shown in FIGS. 1–9, such actuating pistons 44 are pivotally connected to the lower horizontal member 26 of each of the double roller clamp means 14. Upon the actuating pistons being extended, the distance separating adjacent pairs of lower horizontal members 26 is accordingly increased, thereby causing pivotal rotation about the hinge means 34 of one of the double roller clamp means 14 relative to a pivotally connected adjacent clamp means 14.

It is contemplated that the bending device 10 comprise at least three double roller clamp means 14, wherein upon extension of the actuating pistons 44, the two outermost members effectively pivot relative to the intermediate member so as to cause uplifting of the ends of a sheet-like member 12. The intermediate member of the double roller clamp means 14 in effect acts as a fulcrum about which the mutually opposite ends of the sheet-like member 12 may be curved.

It is not necessary that the actuating pistons 44 be pivotally connected to the lower horizontal member 26, and in fact in a further embodiment shown in FIG. 10, it is contemplated the actuating pistons 44 be pivotally connected to the upper horizontal member 28. Accordingly, in this embodiment the actuating piston 44 is adapted to be contracted so as to cause pivotal rotation of one member of a pair of adjacent double roller clamp means 14 relative to the other member, to thereby curve a row of such clamp means 14 to cause bending of the sheet-like member 12.

In a further embodiment of the invention, shown clearly in FIGS. 1, 4 and 6, each of actuating pistons 44 may be laterally slidably coupled to adjacent double roller clamp means 14 along a slidable axis 46. In a preferred embodiment, the slidable axis 46 comprises a rod means 48 to which to the actuating pistons 44, are pivotally and slidably coupled, as shown in FIGS. 4 and 6. Such configuration allows each member of an adjacent pair of double roller clamp means 14 to be laterally slidable relative to each other, and correspondingly allows a row of double roller clamp means 14 to be aligned along a diagonal for bending and curving of sheet-like members 12 along such diagonal.

In the embodiments shown in FIGS. 1–5 and 10, two actuating pistons 44 are contemplated as providing the actuating means, each of the two actuating pistons 44 respectively pivotally coupled at one end thereof to a double roller clamp means 14 proximate the respective extremities 50 thereof, and coupled at their respective other ends proximate the respective extremities 50 of an adjacent double roller clamp means 14.

Accordingly, in the embodiments shown in FIGS. 1–5 and 10, the two actuating pistons 44 are coupled to the double roller clamp means 14 substantially parallel to one another, and substantially perpendicular to the axis of pivotal rotation of the double roller clamp means 14.

In each of the particular embodiments shown in FIGS. 1–6 and 10 having two actuating pistons 44 aligned in a substantially parallel configuration, where each member of a pair of adjacent double roller clamp means 14 is laterally slidable relative to the other, it is necessary to manually uniformly displace each member of each pair of adjacent double roller clamp means 14 relative to the other member, in order to align the double roller clamp means 14 along a diagonal.

Advantageously, however, it has been found that by connecting the two activating pistons 44 in non-parallel relation with each other to adjacent pairs of double roller clamp means 14, as shown in FIGS. 6–9, the desired amount of lateral slidable displacement along, and pivoting about the hinge means 34 of each of the double roller clamp means 14 relative to an adjacent double roller clamp means 14 can be achieved.

Accordingly, FIGS. 6–9, and in particular, FIGS. 8 and 9, clearly illustrate this further preferred embodiment of the invention, wherein first and second non-parallel actuating pistons **44*a*,44*b* are each respectively coupled at one end thereof to one member of an adjacent pair of double roller clamp means 14 proximate the respective extremities 50 of a second roller 18 located on such member 14, and coupled at their respective other ends to the other member of an adjacent pair of double roller clamp means 14, intermediate the extremities 50 of the correspondingly adjacent second roller 18, so as to be in non-parallel relation with each other thereby allowing adjustable extension or contraction of each of the first and second actuating pistons 44*a*,44*b* to cause a desired amount of lateral slidable displacement along, and pivoting about, the hinge means 34 of each of the double roller clamp means 14 relative to an adjacent double roller clamp means 14**.

Figure 7:
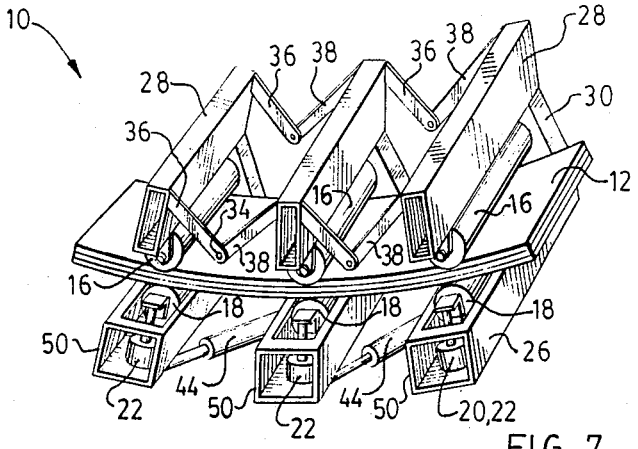
FIG. 7 is a perspective view of a second embodiment of the bending device of the present invention.

As may be seen from comparison of the bending device 10 shown in FIGS. 8 and 9, contraction of pistons **44*b*, shown in FIG. 8, with corresponding extension of pistons 44*a*, would laterally displace the double roller clamp means 14 in an upward position, until the extremities 50 of each of the double roller clamp means 14 are substantially aligned, as shown in FIG. 7. Further extension of pistons 44*a*, with further contraction of pistons 44*b*, would result in the double roller clamp means 14 being further laterally displaced, to form a bending device 10 having the configuration shown in FIG. 9. In this manner, the bending device 10 of the present invention may easily be adjusted to accommodate curving of sheet-like member along an axis inclined to the longitudinal axis of the sheet-like member 12. Accordingly, once the bending device 10 is aligned in the above configuration, a sheet-like member 12 may be placed within the uniformly aligned double roller clamp means 14, and the clamping pistons 22 operated to force the first and second rollers 16 and 18 respectively in clamping engagement with the sheet-like member 12. Subsequently, actuating pistons 44***a*,44*b* may be actuated to cause pivoting about the hinge means 34 which pivotally connects adjacent pairs of double roller clamp means 14. In this manner, the row of double roller clamp means 14 becomes curved, thereby causing curvature of the sheet-like member 12 clampingly held in such device 10.

Upon completion of the bending operation, the operating means 20, in the form of clamping pistons 22, may be deactivated to cause the first 16 and second 18 rollers to clampingly disengage the sheet-like member 12, allowing the member 12, now curved, to be withdrawn from the bending device 10 from the open side 32.

Although the description describes preferred embodiments of the invention, it is not to be limited to such embodiments. Other variations may now become apparent to persons skilled in the art. For a complete definition of the invention, reference should be made to the claims appended to this specification.

What I claim is:

1. A device for curving a sheet-like member comprising:

(a) at least three spaced double roller clamp means, each clamp means having first and second parallel elongated rollers and operating means to open and close the rollers together, the double roller clamp means being arranged in a row to receive and clamp a sheet-like member between the rollers thereof;

(b) a plurality of hinge means, one hinge means being located between and pivotally connected to each adjacent pair of double roller clamp means; and (c) a plurality of actuating means, at least one actuating means being connected between each adjacent pair of double roller clamp means, the actuating means being operable to pivot the double roller clamp means about the hinge means to curve the row of double roller clamp means.

2. The device as claimed in claim 1, said actuating means comprising piston means.

3. The device as claimed in claim 2, said piston means comprising first and second pistons, each connected at their respective ends between an adjacent pair of double roller clamp means.

4. The device as claimed in claim 1, each of said double roller clamp means laterally displaceable along said hinge means relative to an adjacent pivotally connected double roller clamp means.

5. The device as claimed in claim 4, each of said double roller clamp means alignable along a diagonal by uniform lateral displacement along said hinge means relative to an adjacent double roller clamp means.

6. The device as claimed in claim 4, said actuating means comprising first and second pistons, each respectively pivotably coupled at one end thereof to a double roller clamp means proximate respective opposite extremities of said double clamp means, said first and second pistons each coupled at their respective other ends to an adjacent double roller clamp means, so as to be in non-parallel relation with each other, wherein adjustable extension or contraction of each of said first and second pistons produces a desired amount of lateral slidable displacement along, and pivoting about, said hinge means of each of said double roller clamp means relative to an adjacent double roller clamp means.

7. The device as claimed in claim 6, wherein said first and second pistons are coupled at their said respective other ends intermediate the extremities of said adjacent double roller clamp means and proximate the center thereof.

8. The device as claimed in claim 7, wherein said first and second pistons are each coupled to said adjacent double roller clamp means at the same location thereon.

9. The device as claimed in claim 1, said operating means for opening and closing the first and second rollers together comprising piston means.

10. The device as claimed in claim 3, wherein said first and second pistons are pivotally connected to a double roller clamp means proximate said second parallel rollers located thereon.

11. The device as claimed in claim 10, wherein said hinge means is located along an axis substantially intermediate adjacent pairs of first parallel rollers.

12. The device as claimed in claim 1, wherein each of said double roller clamp means is laterally displaceable along the hinge means relative to an adjacent pivotally connected double roller clamp means, said actuating means comprising first and second pistons, each respectively pivotally coupled at one end thereof to the double roller clamp means proximate the respective extremities of a second roller located thereon, said first and second pistons coupled at their respective other ends to an adjacent double roller clamp means intermediate the extremities of a second roller located thereon, so as to be in non-parallel relation with each other, said hinge means located along an axis substantially intermediate the adjacent pairs of double clamp means, wherein adjustable extension or contraction of each of said first and second pistons causes a desired amount of lateral slidable displacement along, and pivoting about, said axis of each of said double roller clamp means relative to an adjacent double roller clamp means.

* * * * *